US006448930B1

(12) United States Patent
Judd

(10) Patent No.: US 6,448,930 B1
(45) Date of Patent: Sep. 10, 2002

(54) INDOOR ANTENNA

(75) Inventor: Mano D. Judd, Rockwall, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/687,320

(22) Filed: Oct. 13, 2000

Related U.S. Application Data

(63) Continuation-in-part of application No. 09/483,649, filed on Jan. 14, 2000, and a continuation-in-part of application No. 09/418,737, filed on Oct. 15, 1999, now Pat. No. 6,160,514.

(51) Int. Cl.[7] ..... H01Q 1/38
(52) U.S. Cl. ..... 343/700 MS; 343/853
(58) Field of Search ..... 343/700 MS, 795, 343/844, 856, 878, 879, 880, 881, 882, 876; 342/373, 374, 375

(56) References Cited

U.S. PATENT DOCUMENTS

| | | | | |
|---|---|---|---|---|
| 3,728,733 A | | 4/1973 | Robinson | 343/765 |
| 3,731,315 A | | 5/1973 | Sheleg | 347/854 |
| 4,032,922 A | | 6/1977 | Provencher | 343/854 |
| 4,124,852 A | | 11/1978 | Steudel | 343/854 |
| 4,189,675 A | | 2/1980 | Reilly et al. | 325/4 |
| 4,246,585 A | | 1/1981 | Mailloux | 343/854 |
| 4,318,104 A | | 3/1982 | Enein | 343/100 |
| 4,338,605 A | | 7/1982 | Mims | 343/100 |
| 4,352,202 A | | 9/1982 | Carney | 455/151 |
| 4,360,813 A | | 11/1982 | Fitzsimmons | 343/100 |
| 4,407,001 A | | 9/1983 | Schmidt | 343/840 |
| 4,446,463 A | | 5/1984 | Irzinski | 343/371 |
| 4,566,013 A | | 1/1986 | Steinberg et al. | 343/372 |
| 4,570,165 A | | 2/1986 | Tsurumaru et al. | 343/726 |
| 4,689,631 A | | 8/1987 | Gans et al. | 343/781 |
| 4,825,172 A | | 4/1989 | Thompson | 330/124 R |
| 4,843,402 A | | 6/1989 | Clement | 343/758 |
| 4,849,763 A | | 7/1989 | DuFort | 342/372 |
| 4,879,711 A | | 11/1989 | Rosen | 370/50 |
| 4,890,110 A | | 12/1989 | Kuwahara | 342/35 |
| 4,973,971 A | | 11/1990 | Sinsky et al. | 342/373 |
| 4,994,813 A | | 2/1991 | Shiramatsu et al. | 342/360 |
| 5,019,793 A | | 5/1991 | McNab | 333/156 |
| 5,034,752 A | | 7/1991 | Pourailly et al. | 342/373 |
| 5,086,302 A | | 2/1992 | Miller | 342/373 |
| 5,089,823 A | | 2/1992 | Vasile | 342/383 |
| 5,128,687 A | | 7/1992 | Fay | 343/754 |
| 5,230,080 A | | 7/1993 | Fabre et al. | 455/15 |
| 5,243,354 A | * | 9/1993 | Stern et al. | 343/700 MS |
| 5,248,980 A | | 9/1993 | Raguenet | 342/354 |
| 5,280,297 A | | 1/1994 | Profera, Jr. | 343/754 |
| 5,291,211 A | * | 3/1994 | Tropper | 343/890 |
| 5,327,150 A | | 7/1994 | Cherrette | 343/771 |
| 5,351,060 A | | 9/1994 | Bayne | 343/766 |
| 5,379,455 A | | 1/1995 | Koschek | 455/273 |
| 5,463,401 A | | 10/1995 | Iwasaki | 342/359 |
| 5,485,170 A | | 1/1996 | McCarrick | 343/895 |
| 5,486,835 A | | 1/1996 | Hock | 342/359 |

(List continued on next page.)

FOREIGN PATENT DOCUMENTS

| | | | |
|---|---|---|---|
| EP | 0936693 A1 | 2/1998 | H01Q/1/00 |
| GB | 2286749 A | 8/1996 | H04B/7/08 |
| WO | WO 95/34102 | 12/1995 | H01Q/1/38 |
| WO | WO 98/09372 | 3/1998 | H03F/1/32 |
| WO | WO 98/11626 | 3/1998 | H01Q/23/00 |
| WO | WO 98/50981 | 11/1998 | H01Q/3/40 |

OTHER PUBLICATIONS

EP Search Report for EP00122143.1 dated Jan. 19, 2001.

*Primary Examiner*—Tan Ho
(74) *Attorney, Agent, or Firm*—Wood, Herron & Evans, L.L.P.

(57) ABSTRACT

An indoor antenna includes a unitary support structure having a plurality of support surfaces. At least one antenna element is mounted to each of the support surfaces. The support surfaces are configured and oriented to achieve substantially 360° coverage by the antenna elements.

55 Claims, 16 Drawing Sheets

U.S. PATENT DOCUMENTS

| | | | | |
|---|---|---|---|---|
| 5,512,906 | A | | 4/1996 | Speciale ..... 342/375 |
| 5,589,843 | A | | 12/1996 | Meredith et al. ..... 343/820 |
| 5,596,329 | A | | 1/1997 | Searle et al. ..... 342/374 |
| 5,604,462 | A | | 2/1997 | Gans et al. ..... 330/124 R |
| 5,619,210 | A | | 4/1997 | Dent ..... 342/352 |
| 5,633,647 | A | | 5/1997 | Tines ..... 343/766 |
| 5,633,736 | A | | 5/1997 | Webb et al. ..... 359/17 |
| 5,644,622 | A | | 7/1997 | Russell et al. ..... 455/422 |
| 5,646,631 | A | | 7/1997 | Arntz ..... 342/373 |
| 5,710,804 | A | | 1/1998 | Bhame et al. ..... 379/58 |
| 5,714,957 | A | | 2/1998 | Searle et al. ..... 342/374 |
| 5,751,250 | A | | 5/1998 | Arntz ..... 342/373 |
| 5,754,138 | A | | 5/1998 | Turcotte et al. ..... 342/373 |
| 5,754,139 | A | | 5/1998 | Turcotte et al. ..... 342/373 |
| 5,758,287 | A | | 5/1998 | Lee et al. ..... 455/450 |
| 5,767,807 | A | | 6/1998 | Pritchett ..... 342/374 |
| 5,770,970 | A | | 6/1998 | Ikeda ..... 330/286 |
| 5,854,611 | A | | 12/1998 | Gans et al. ..... 342/373 |
| 5,856,804 | A | | 1/1999 | Turcotte et al. ..... 342/371 |
| 5,862,459 | A | | 1/1999 | Charas ..... 455/114 |
| 6,043,790 | A | | 3/2000 | Derneryd et al. ..... 343/853 |
| 6,160,514 | A | * | 12/2000 | Judd ..... 343/700 MS |
| 6,198,460 | B1 | * | 3/2001 | Brankovic ..... 343/879 |
| 6,222,502 | B1 | * | 4/2001 | Falbo et al. ..... 343/879 |
| 6,222,503 | B1 | | 4/2001 | Gietema et al. ..... 343/890 |

* cited by examiner

INDOOR ANTENNA

CROSS-REFERENCE TO RELATED APPLICATION

This is a continuation-in-part of U.S. patent applications Ser. No. 09/418,737, filed Oct. 15, 1999 now U.S. Pat. No. 6,160,514 entitled "L-Shaped Indoor Antenna" and Ser. No. 09/483,649, filed Jan. 14, 2000, entitled "RF Switched Beam Planar Antenna." The disclosures of these applications are incororated herein by reference.

BACKGROUND OF THE INVENTION

In conventional cellular and PCS (personal communications system) wireless systems, signals transmitted from a base station (cell site) to a user (remoter terminal) are usually received via an omni-directional antenna; often in the form of a stub antenna. These systems often sacrifice bandwidth to obtain better area coverage, stemming from the result of less than desirable signal propagation characteristics. For instance, the bit (binary digit) to Hz ratio of the typical digital Cellular or PCS system is often less than 0.5. Lower binary signal modulation types, such as BPSK (Binary Phase Shift Keying) are used, since the effective SNR (Signal to Noise Ratio) or C/I (Carrier to Interference Ratio) are often as low as 20 dB. In fact, for voice based signaling, the threshold C/I (or S/N) ratio for adequate quality reception of the signal is about 17 dB.

For wireless systems directed towards data applications, it is desirable to significantly increase the SNR or C/I in order to employ higher order (binary) modulation techniques, such as QAM-64 (Quadrature Amplitude Modulation, with 64 points in the complex constellation). These higher order modulation schemes require substantially greater C/I (or SNR) thresholds; typically higher than 26 dB. For the case of MMDS (multi-user multipath distribution system) signals, where the carrier frequencies are higher (around 2500 MHz), the propagation characteristics are even worse. There is a need therefore for transmission systems that can both satisfy the coverage (propagation) demands,,as well as generate high C/I or SNR levels.

One option is to increase the size of the terminal equipment (TE), or remote, antenna gain. This requires increasing the size. Additionally, it helps to increase the elevation (i.e., vertical height above ground level) of the antenna. The higher you place an antenna, the better the system gain. For a simple planar earth model, the total system path loss (attenuation) is a function of each (transmit and receive) antenna's directive gain (towards one another). However, this path loss is also a function of the height (from ground level) of each antenna. Thus, as you increase the height, from ground, the total system path loss decreases, which is an increase in the overall system link performance, or system gain. The link performance (system) gain increases 6 dB every time you double one of the antenna's height from the ground level. If you double both (i.e., transmitting and receiving) antennas' heights, the total gain (link performnance) goes up by 12 dB (6 dB+6 dB). Therefore, doubling the height from the ground is equivalent to quadrupling the size (area) of the antenna; which produces 4× (or 6 dB) of directive gain.

In conventional analog MMDS systems, this (i. e., increase of SNR or C/I) has been traditionally accomplished by installing a large reflector type antenna (with up to 30 dBi of directional gain) on a rooftop, or a pole. The disadvantages are a complex, difficult, and costly installation; as well as poor aesthetics.

The migration of the MMDS frequency spectrum, from an analog video system, to a wireless data and Internet system, demands a more user friendly (easier) installation method, with much lower cost. The difficulty here is designing a system with sufficient directional gain, as to overcome loss with transmission through walls, as well as being easy to install, and orient; by the consumer, or other persons without specialized skills.

SUMMARY OF THE INVENTION

In accordance with one aspect of the invention, there is provided an easy to install, high gain, omni-directional "indoor" antenna which provides omni-directional coverage. No installation, "pointing" or orientation is required, and the antenna may be installed indoors in a corner of a room.

In accordance with another aspect of the invention, four antenna elements are formed as a "book," that is, two each, back to back; with the pairs oriented at 90° to each other, such that each separate antenna covers a 90° sector, so that the coverage of the antennas when summed creates a full 360° coverage.

In accordance with another aspect of the invention, an indoor antenna comprises a unitary support structure having a plurality of support surfaces; at least one antenna element mounted to each of the support surfaces; and the support surfaces being In accordance with another aspect of the invention, a method of transmitting and receiving RF signals comprises coupling a first support member having a first pair of opposed planar support surfaces along a common edge with a second support member having a second pair of opposed planar support surfaces, orienting the first and second support members such that first pair of planar support surfaces are substantially orthogonal to the second pair of planar support surfaces, mounting at least one antenna element to each of a plurality of support surfaces, and arranging the support surfaces in a unitary support structure with the support surfaces oriented to achieve substantially 360° coverage by the antenna elements.

In accordance with another aspect of the invention, a method of transmitting and receiving RF signals comprises mounting at least one antenna element to each of a plurality of support surfaces, and arranging the support surfaces on a unitary support structure with the support surfaces and antennas oriented to achieve substantially 360° coverage.

DETAILED DESCRIPTION OF THE ILLUSTRATED EMBODIMENT

Figure 1:
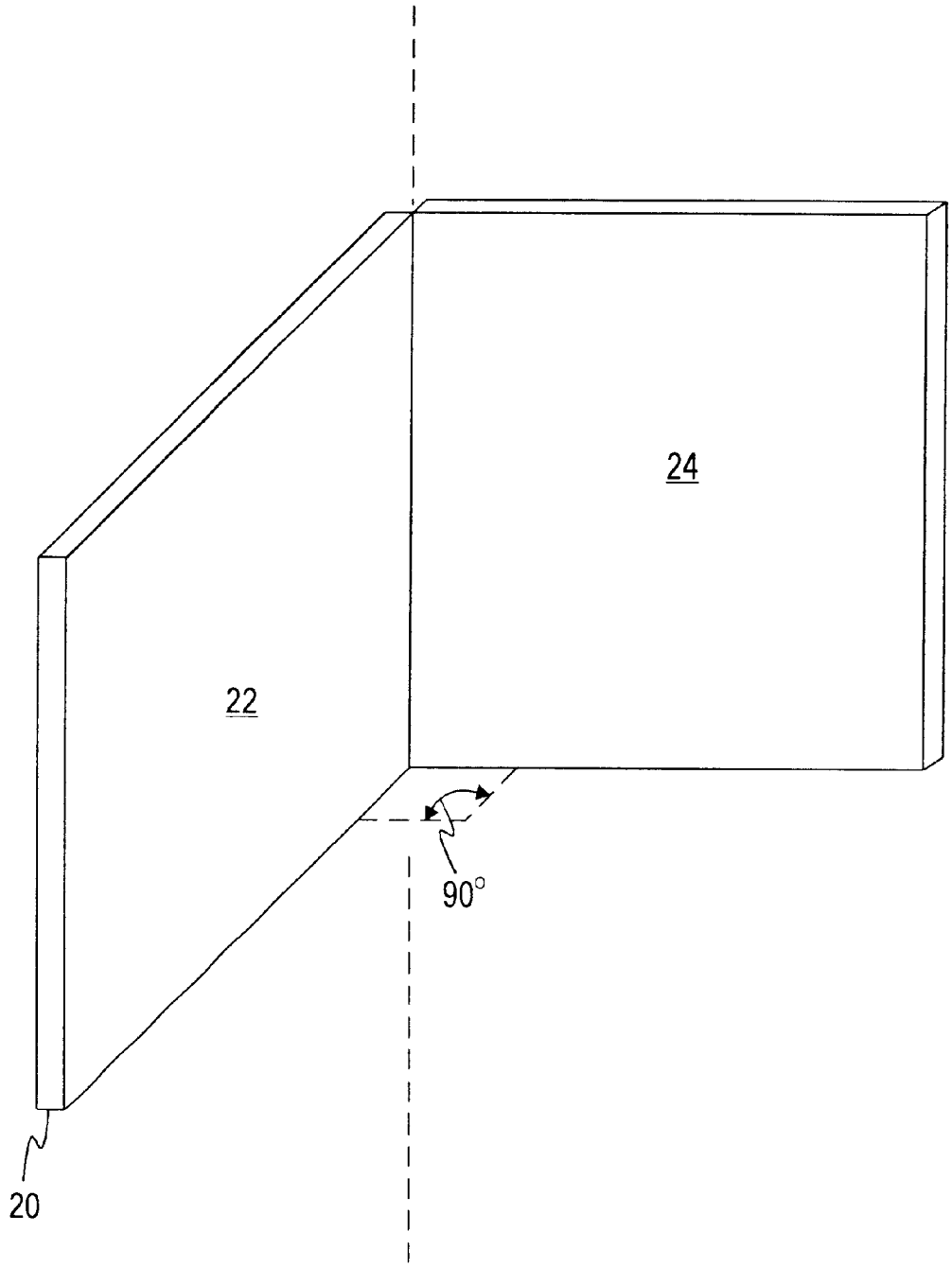
FIG. 1 is a perspective view showing an antenna in accordance with the one form of the invention.
Figure 2:
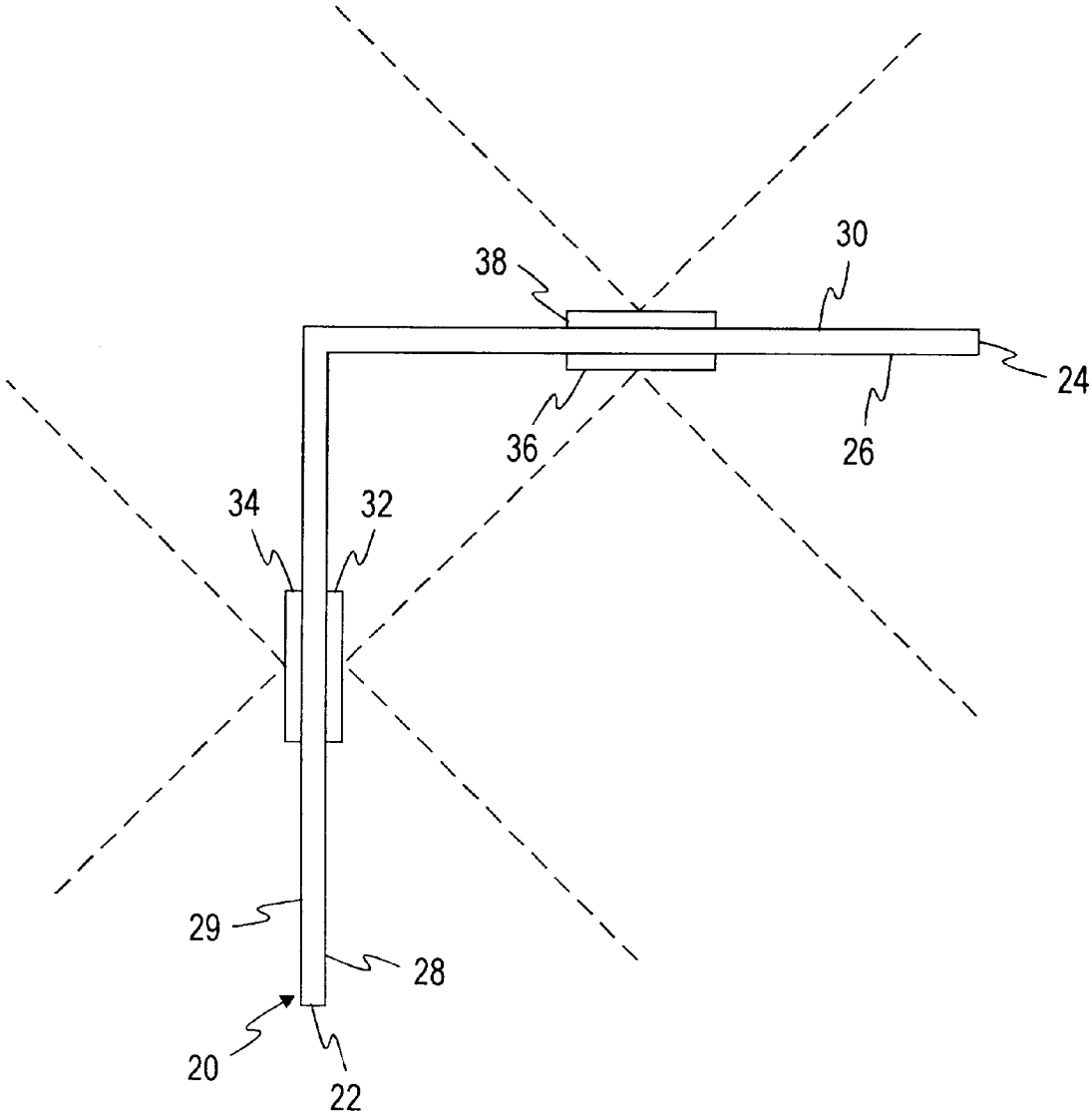
FIG. 2 is a top plan view of the antenna of FIG. 1.

Referring initially to FIG. 1 and FIG. 2, there is shown the general structure for a "book" antenna system 20 in accordance with one embodiment of the invention, having two rectangular (shown square in FIG. 1) sections 22, 24 joined along a common edge. The two sections, 22, 24 are joined at a 90 degree angle, thus allowing the antenna 20 to fit squarely into a corner, between two walls, in a room (see FIG. 3), so as to resemble an open "book" in appearance.

Using microstrip (patch) antenna technology allows the thickness of the sections 22, 24 to be well under one inch. Each section 22, 24 is comprised of a front (26, 28) and a back (29, 30), with each face (front and back) containing an antenna element 32, 34, 36, 38 (or multiplicity of elements, in an array, see, e.g., FIGS. 4, 5 and 7). Thus there are four (4) distinct antenna faces, each pointing in opposing or orthogonal directions from one another.

FIG. 2 shows a top view of the antenna system, denoting the four distinct faces 26, 28, 29 and 30. Each face contains a microstrip/patch antenna 32, 34, 36 and 38. For this particular example, each patch antenna 32, 34, 36, 38 generates a 90° azimuth beam width. The combination of the four 90 degree beams generates an effective 360 degree coverage; thereby emulating an omnidirectional antenna.

Figure 3:
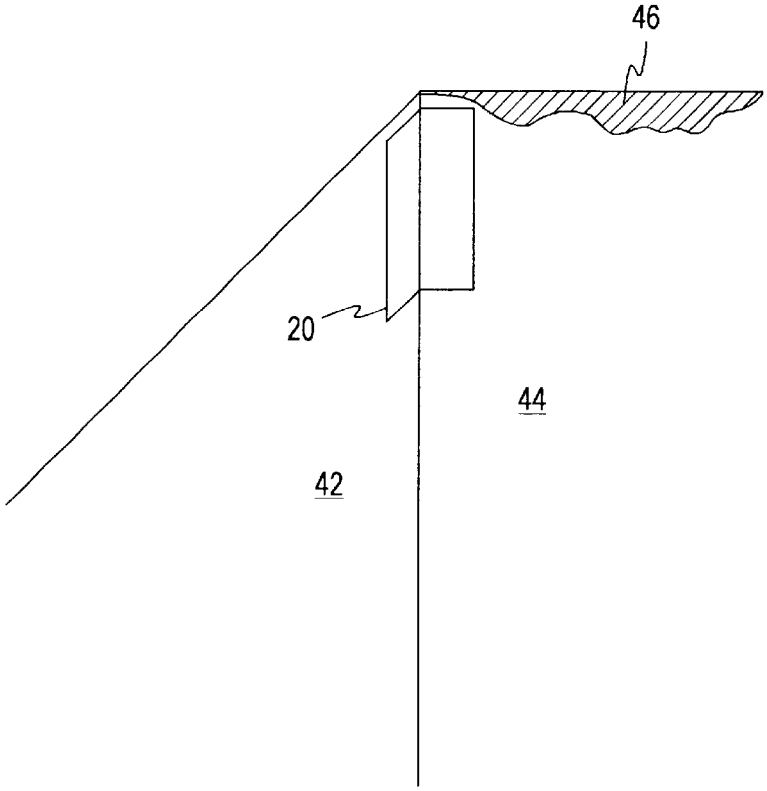
FIG. 3 is a perspective view, showing an antenna in accordance with one embodiment of the invention placed in a typical room.

FIG. 3 shows the placement of the antenna 20 at the corner of two walls 42, 44. For optimal performance the antenna system should be placed as high as possible (i.e. near the ceiling 46) to maximize signal reception and transmission to a base station (not shown).

Figure 4:
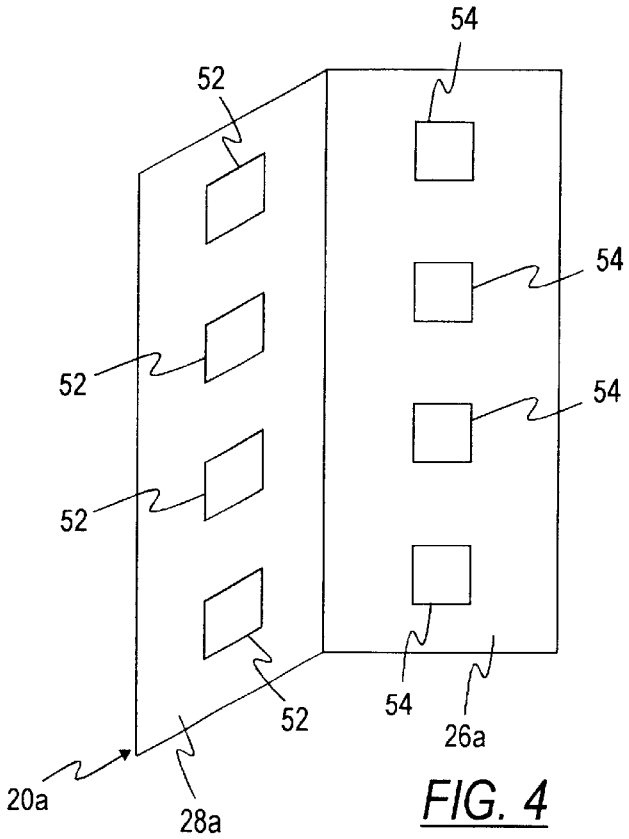
FIGS. 4 and 5 are views similar to FIG. 1, showing antennas in accordance with two further embodiments of the invention.
Figure 5:
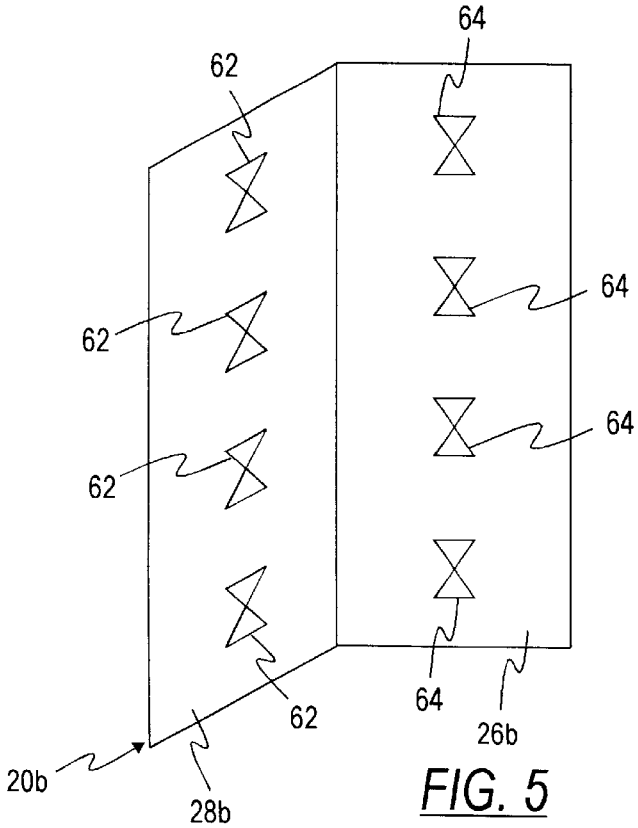

FIGS. 4 and 5 show two different variants of antenna element types, which can be used as or in place of the antenna elements 32, 34, 36, 38 of the preceding embodiments. FIG. 4 shows a vertical array (multiplicity of elements) of patch/microstrip antenna elements 52, 54, on each face 26*a*, 28*a* of a "book" antenna 20*a*. It will be understood that similar arrays are on the rear faces which are not visible in FIG. 4. For the case of a multiplicity of antenna elements (on each face) a parallel or series corporate feed structure (not shown) would be used, designed for correct amplitude and phase matching, to generate the desired elevation beam. FIG. 5 shows the same sort of arrays, however, using dipole antenna elements 62, 64, on faces 26*b*, 28*b* of "book" antenna 20*b*. Similar arrays of dipoles are used on the other two faces which are not visible in FIG. 5.

Figure 6:
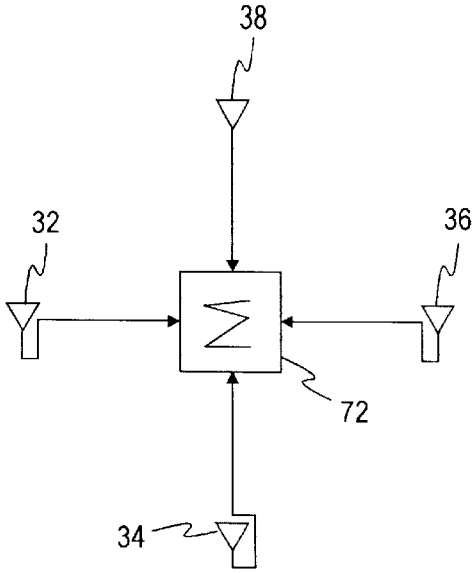
FIG. 6 is a schematic showing of a summation/splitting device.

FIG. 6 shows a summation/splitting mechanism 72, in which the input/output path(s) from the antenna element(s) on each face of the "book" antenna of any of the preceding figures is RF summed to generate a single RF input/output path to/from the antenna system. For each of the four faces, the array corporate feed (or RF transmission line, for the case of a single element) is summed, in phase, with the other faces, to generate a single RF input/output.

Figure 7:
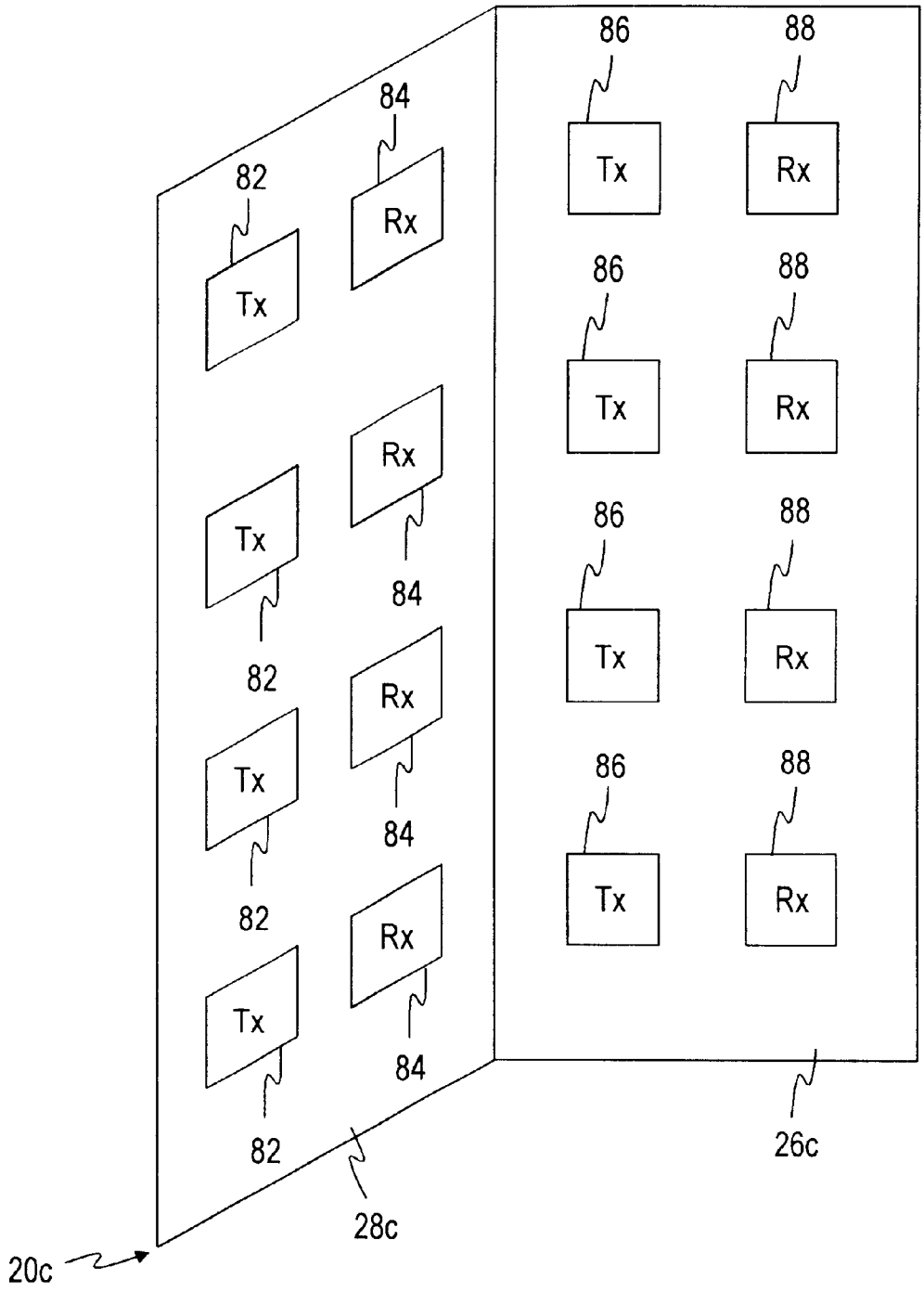
FIG. 7 is a view similar to FIG. 1 showing an antenna in accordance with yet another embodiment of the invention.

Up to this point, it has been assumed that the transmit and receive bands of the system are all within the VSWR bandwidth of a single patch/microstrip (or dipole) element. However, for the case where the transmit and receive bands of the system are further apart (say, more than 10% of the carrier frequency), then two different arrays can be used for each face. Shown in FIG. 7, is the case where there is a transmit (Tx) patch/microstrip (or dipole) array (vertical) 82, 86 and a receive (Rx) array (vertical) 84, 88, on each face 26*c*, 28*c* of antenna 20*c*. The same arrangement of Tx and Rx elements would be used on the faces which are not visible in FIG. 7. Two distinct sum/split circuits of the type shown in FIG. 6 would be used (see e.g., FIG. 8)—one for Tx and one for Rx, generating two distinct, separate RF ports (one for the transmit band, and one for the receive band). The antenna system can therefore output two different RF transmission lines, or cable, or (frequency) diplex them (via a frequency diplexer module 95, see FIG. 8) into a single RF transmission line, or cable 90.

Figure 8:
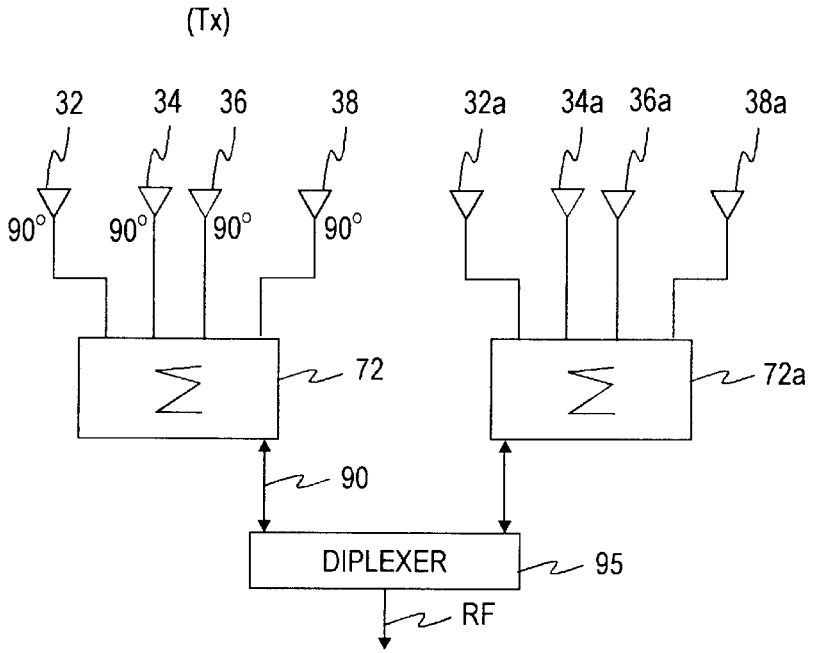
FIG. 8 is a schematic view, similar to FIG. 6, further illustrating a summer/splitter.
Figure 9:
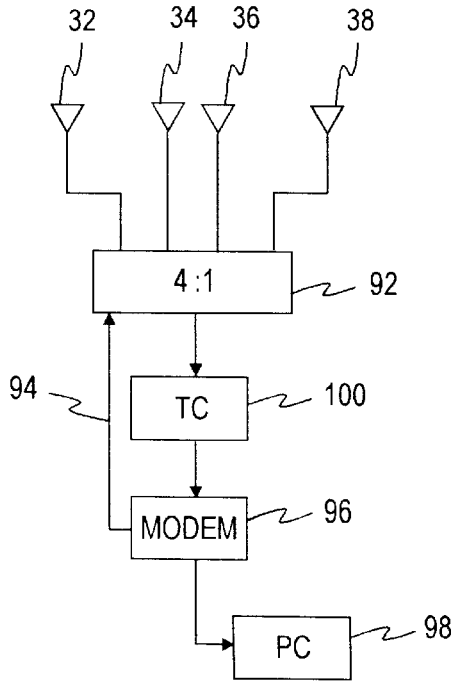
FIG. 9 is a schematic view illustrating use of a 4:1 RF switch with control from a modem.

The concept as described thus far generates an omnidirectional system, which splits the power (four ways) from the input/output transmission line, to each independent 90 degree sector "face," as indicated in FIG. 8. However, this splitting/summing device 72 (72*a*) has the effect of reducing the overall system directional gain by 6 dB. One method to overcome this is to substitute a 4:1 RF switch 92 as shown in FIG. 9. This can be a combination of PIN diodes (not shown), which are biased/controlled via a control line 94 (or set of control lines) from a modem 96. The modem 96, or an associated controller or "PC" 98 can be programmed to sequentially switch the RF path to each antenna face, measure the RF power, and then select the face with the maximum power. A suitable RF transceiver/transverter (Tc) 100 is interposed between the 4:1 RF switch 92 and the modem 96. In this case, the system would still have omni-directional capability, yet would increase the overall system (directive) gain by 6 dB. This additionally reduces the amount of signal scattered throughout the network, and increases the overall network C/I. This also increases the user friendliness of the system, allowing easier installation by the user, with the antenna "pointing" done by the system itself.

Figure 10:
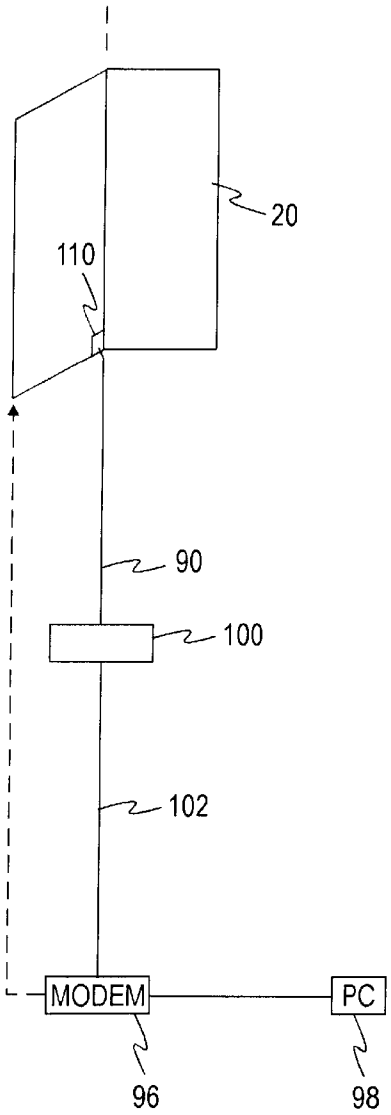
FIG. 10 is a diagrammatic showing of an antenna in accordance with one form of the invention, having an internal RF summer/splitter.

FIG. 10 shows one embodiment of the "book" antenna 20 of the invention at a comer of two walls 42, 44, with an internal (i.e., built into the antenna structure) RF Summer/Splitter or a 4:1 RF switch 110, with control from the modem 96 shown by the dotted line in the case of a 4:1 RF switch. The RF output (coaxial line) 90 from the antenna system can run down the corner of the wall into the RF transceiver 100 (or "transverter", as it is denoted in the MMDS industry). The RF transceiver 100 is interfaced to the modem 96 via an IF cable 102 (coaxial or twisted pair). The RF switch 110 may be physically mounted to the surface of the substrate or backplane (such as a printed circuit board or card) which forms one of the sections 22, 24.

Figure 11:
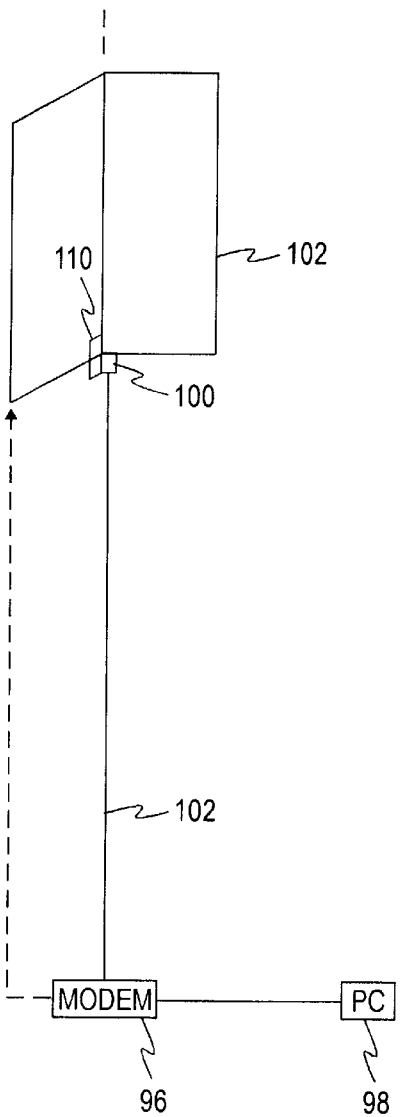
FIG. 11 is a view similar to FIG. 10 showing an RF transceiver or transverter incorporated into the antenna assembly.

FIG. 11 shows an embodiment where the RF transceiver ("transverter") 100 is also incorporated into the antenna assembly. This can be accomplished via a separate (transceiver) box attached to the unit, or by incorporating the transceiver electronics onto the same PCB material as the microstrip antennas.

Figure 12:
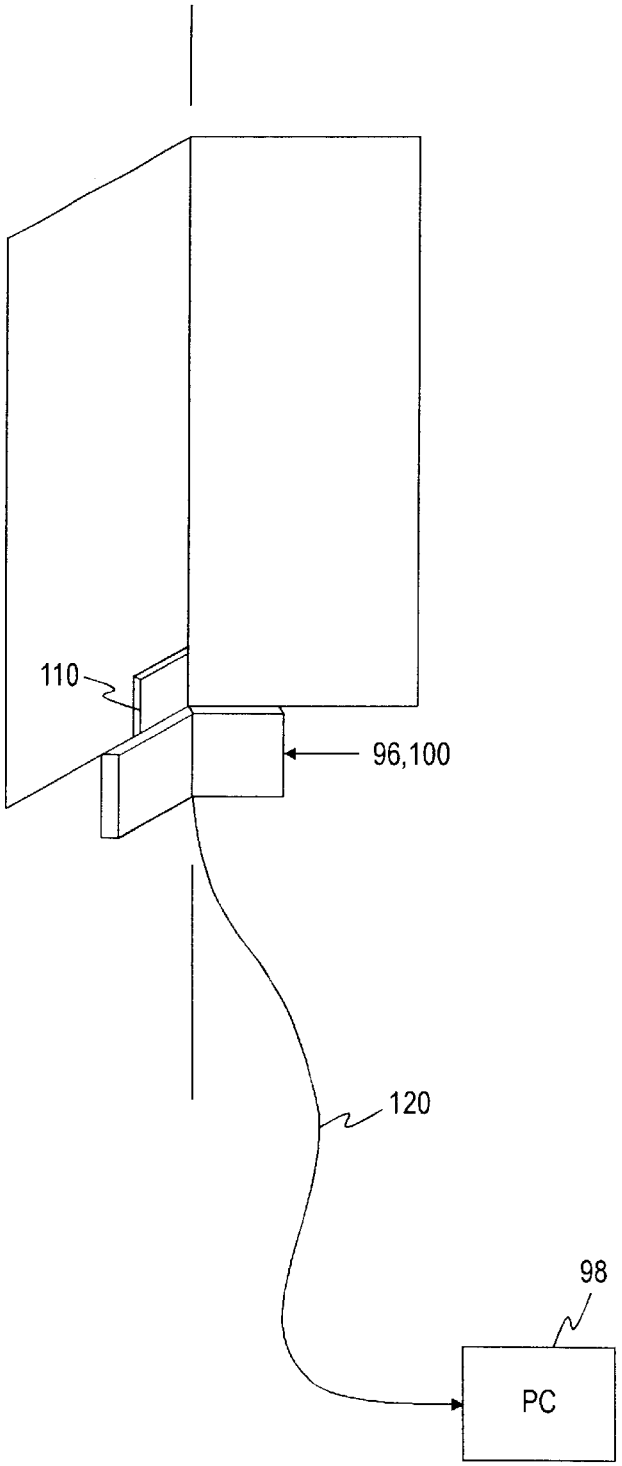
FIG. 12 is a view similar to FIGS. 10 and 11 showing both a transceiver and modem incorporated into the antenna assembly.

FIG. 12 shows incorporation of both the transceiver 100 and modem 96 into the antenna assembly. Here, an Ethernet or USB (Universal Serial Bus) cable 120 is run down the wall comer directly to the PC 98, or LAN network server.

Figure 13:
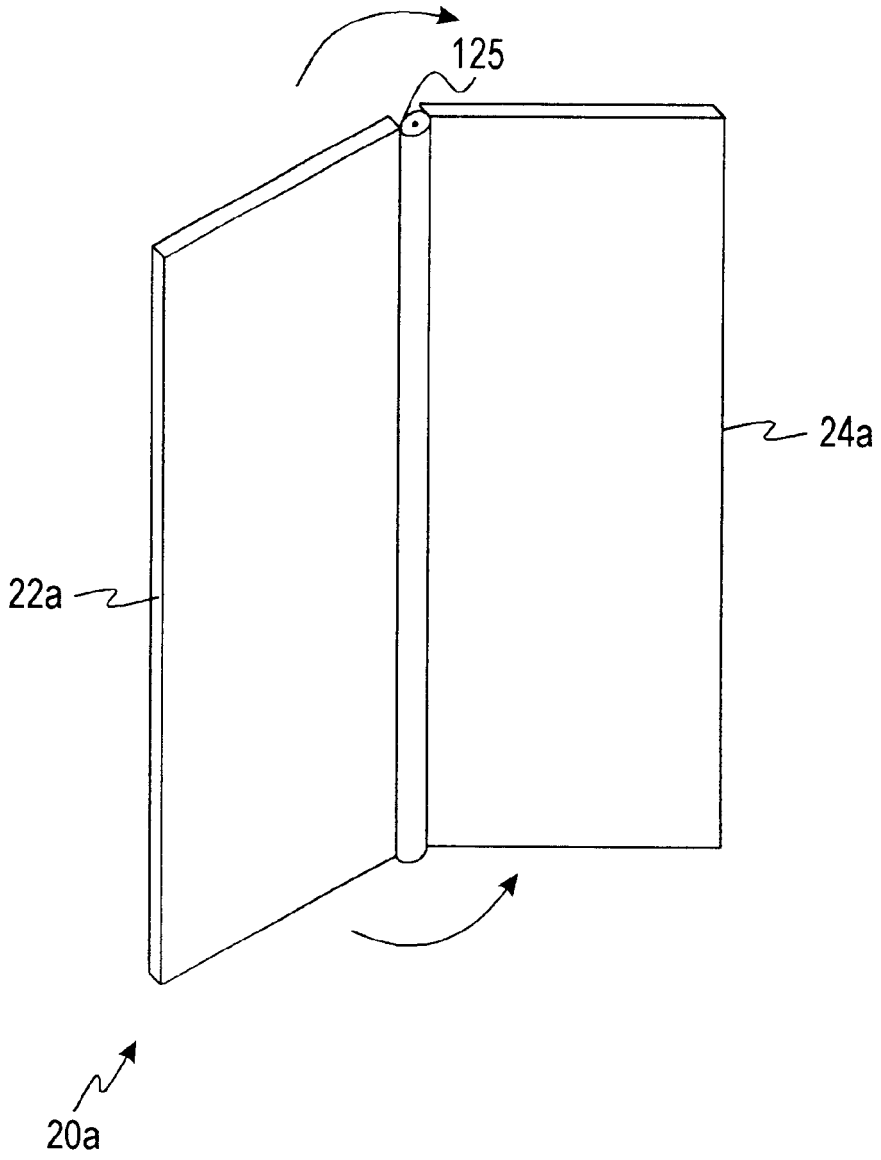
FIG. 13 is a perspective view, similar to FIG. 1, showing an antenna in accordance with yet another embodiment of the invention, employing a hinged construction.

FIG. 13 shows a generally L-shaped antenna structure similar to that of FIGS. 1 and 2, and designated generally by reference numeral 20*a*. The antenna 20*a* employs flat panels 22*a* and 24*a* which have oppositely facing surfaces on which antenna elements (not shown in FIG. 13) may be mounted in similar fashion to FIG. 2, or, in some other configuration as will be more fully discussed hereinbelow. Departing from the embodiment of FIGS. 1 and 2, the embodiment of FIG. 13 is provided with a hinged connection 125 between the respective panels 22*a* and 24*a*. Thus, the two panels 22*a* and 24*a* may be pivoted or rotated with respect to each other to fit in either an inside comer of a wall or an outside comer of a wall, with the respective panels being impedance matched to the wall. The structure of FIG. 13 could also be adjusted so that the panels 22*a* and 24*a* are at some angle other than right angles with respect to each other if required for a particular application.

Figure 14:
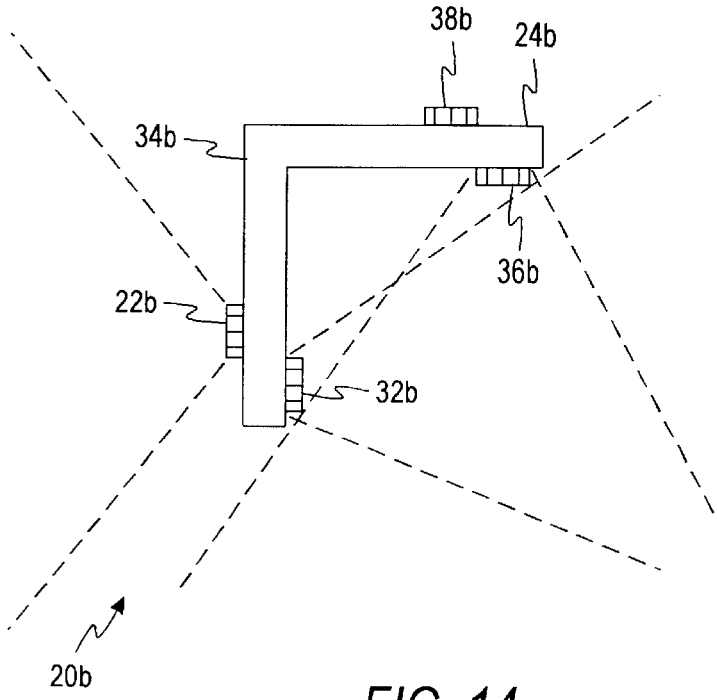
FIG. 14 shows an antenna similar to the antenna of FIG. 2, but with a different placement of radiating elements.

Referring next to FIG. 14, a generally L-shaped antenna 20*b* similar to that of FIGS. 1 and 2 is illustrated. The antenna 20*b* has respective flat panels 22*b*, 24*b* which define oppositely facing generally flat surfaces, each of which mounts at least one antenna or radiating element, 32*b*, 34*b*, 36*b* and 38*b*. It will be noted that departing from the embodiment of FIG. 2, the respective antenna elements or radiating elements on each oppositely pair of surfaces are offset somewhat. That is, the antenna elements 32*b* and 36*b* are located closer to outer edges of the respective panels 22*b* and 24*b* than the antenna elements 34*b* and 38*b*, which are substantially centered. This placement of the antenna elements 32*b* and 36*b* permits their radiating patterns (shown in broken lines) to extend at a somewhat wider angle before encountering respective outer edges of the panels 22*b* and 24*b*, to achieve a somewhat wider angle of coverage than if these elements 32*b* and 36*b* were located centered or farther in toward the corner with respect to panels 22*b* and 24*b* whereby the outer edges of the panels would cut off more of the radiating pattern, reducing the effective angle of coverage somewhat. This would be the case in the embodiment where the panels 22, 22*b* and 24, 24*b* are printed circuit boards or other flat panels having conductive surfaces or conductive coating forming a backplane for the respective antenna elements.

Figure 15:
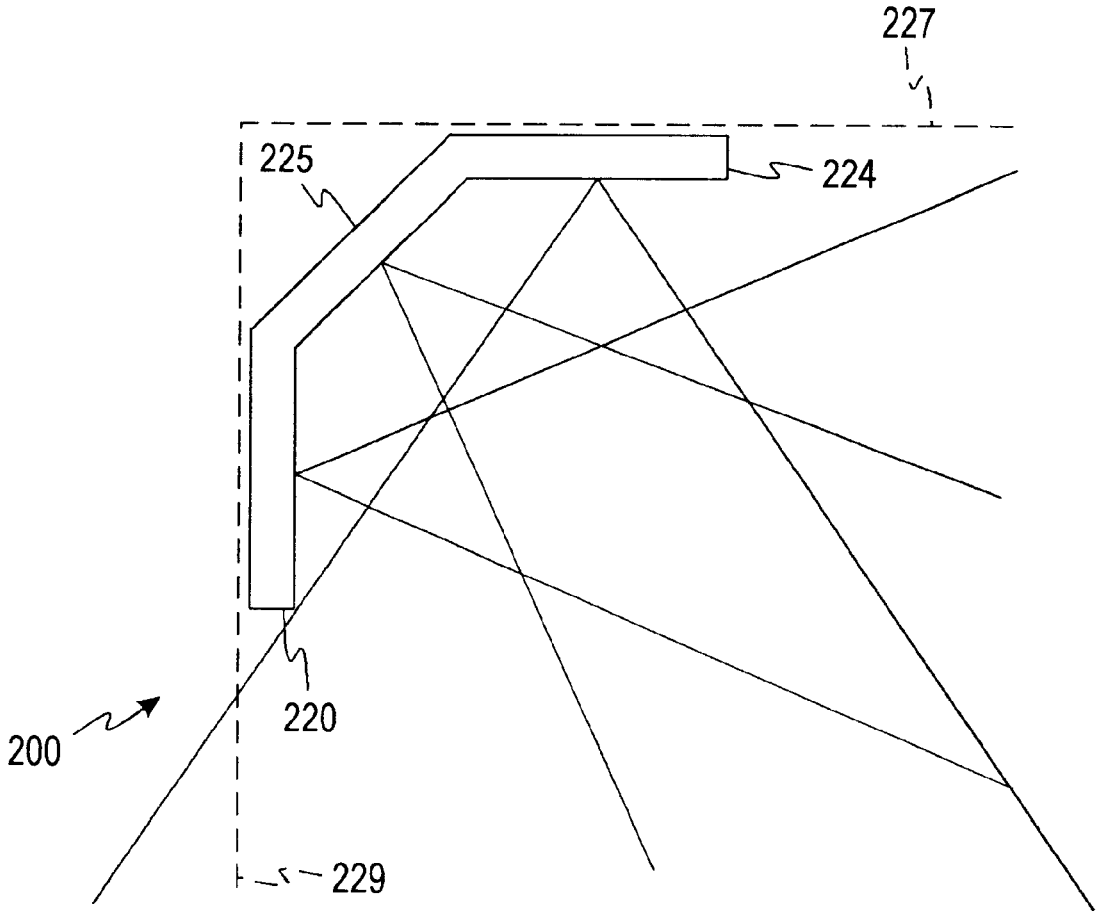
FIG. 15 shows yet another embodiment of an antenna in accordance with the invention, utilizing three panels.

Referring next to FIG. 15, a further embodiment of an antenna is designated generally by reference numeral 200. The antenna 200 has respective flat panels 220 and 224 having oppositely facing surfaces, each of which may mount at least one antenna element (not shown). In the embodiment illustrated in FIG. 15, the antenna elements are substantially centered on the respective opposite surfaces of each of the panels 220 and 224 as indicated by the radiation patterns (shown in broken lines). In this case, each of the antenna elements is indicated as having a substantially 60° radiating pattern. The panels 220 and 224 are located at right angles to each other and are joined by a third, or center panel 225 which is substantially centered between the panels 220 and 224. This structure is such that the panels 220 and 224 mount directly or flush against respective wall surfaces, spaced outwardly somewhat from an inner corner of two wall surfaces indicated at generally by broken lines 227, 229 in FIG. 15. Thus, the centered panel 225 generally spans the corner, forming an angle of substantially 45° with respect to each of the two wall surfaces 227 and 229 shown in phantom line in FIG. 15.

The third or center panel 225 also has at least one antenna element mounted substantially centrally on each of its opposite surfaces with respect to plan or overhead view shown in FIG. 15, and also having a substantially 60° radiation pattern as indicated by the broken lines in FIG. 15. Thus, at least one antenna element on each of the panels 220, 224 and 225 covers substantially 60°, resulting in substantially 180° of coverage. Similarly, the (at least) three antennas mounted on the opposite surfaces would cover the remaining 180° to achieve substantially 360° of coverage by the structure shown in FIG. 15. Also, it is noted that with the structure of FIG. 15, the antenna elements mounted on the inner surfaces of the panels 220 and 224 will not have their 60° radiation patterns cut off by outer edges of the panels 220 and 224. Rather, these panels are spaced sufficiently far apart from the corner of the walls 227 and 229 by the center panel 225, such that the 60° patterns of the substantially centered antenna elements do not encounter the outer edges of the panels 220 and 224.

Figure 16:
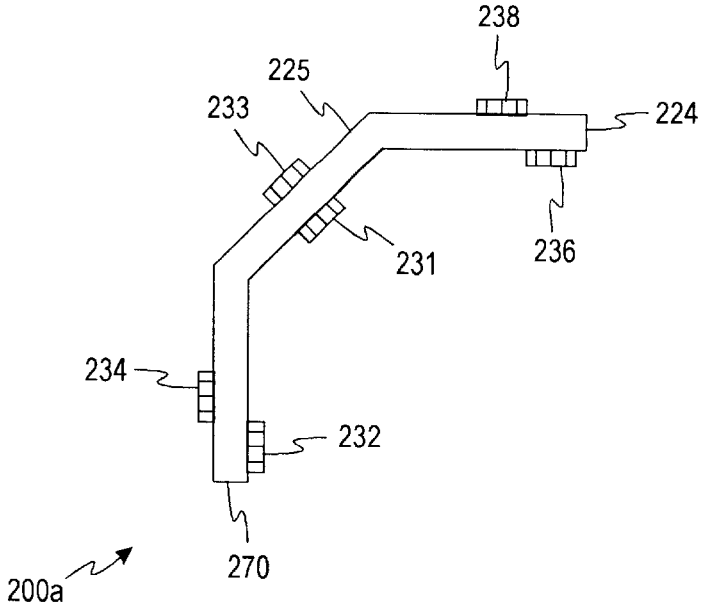
FIG. 16 shows an embodiment similar to the embodiment of FIG. 15 with a different placement of radiating elements, similar to that of FIG. 14.

Referring briefly to FIG. 16, a substantially similar structure 200*a* is shown in which respective antenna elements are shown mounted to the respective panels 220, 224 and 225. Here, antenna elements 231 and 233 are located on opposite sides of the center panel 225 and are substantially centered in the top or plan view of FIG. 16. However, respective elements 236 and 238 and 232, 234 are relatively offset, in much the same fashion as described above with reference to FIG. 14.

Figure 17:
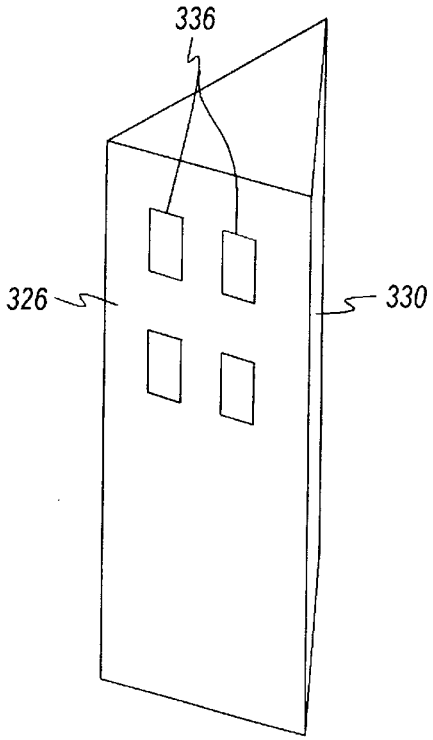
FIG. 17 shows a triangular or 3-sided antenna structure.
Figure 18:
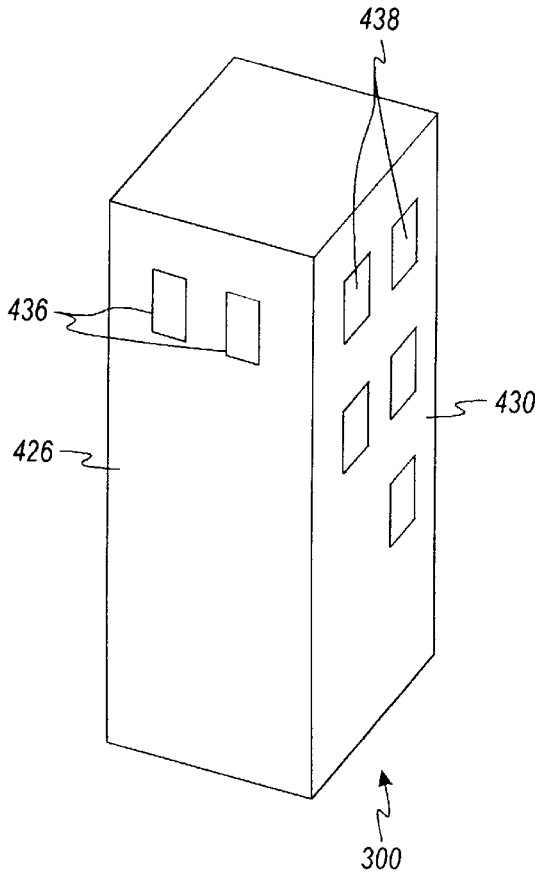
FIG. 18 shows a rectangular or 4-sided antenna structure.
Figure 19:
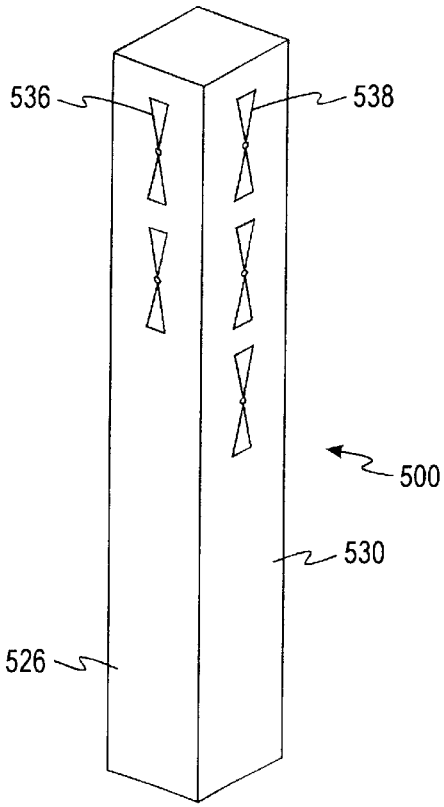
FIG. 19 shows a rectangular structure similar to FIG. 18, utilizing a single row of radiating antenna elements such as dipoles.
Figure 20:
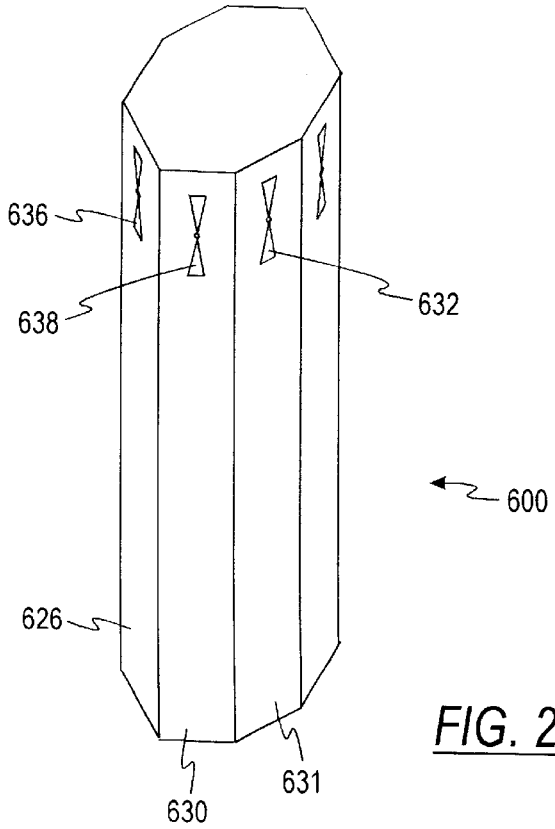
FIG. 20 shows a multiple sided (6-sided) configuration of an antenna structure.

Referring next to FIGS. 17–20, in accordance with yet another form of the invention, the antenna may have a generally polygonal body having three or more outwardly facing, substantially flat surfaces which mount antenna elements for substantially 360° coverage. FIGS. 17 and 18 illustrate a generally triangular and generally rectangular or square cross-sectional configuration of the antenna body or support structure. Each of these structures have substantially identical sides or radiating faces 326, 330 and 426, 430, etc. each of which mounts respective antenna elements 336, 436, 438, etc. In the embodiments shown in FIGS. 17 and 18 two columns of patch antenna elements are illustrated on each of the antenna faces or surfaces. However, other forms of radiating elements such as dipoles, slots, etc. might be utilized without departing from the invention. Also, as shown for example in FIG. 19, a single column of antenna element may be utilized on each face. In the antenna 500 of FIG. 19, each face 526, 530 mounts a single row of radiating elements 536, 538 which are shown in FIG. 19 as dipoles. Similarly, FIG. 20 shows a polygonal or hexagonal cross-sectional shape of the antenna body or structure which has six faces, of which three faces 626, 630 and 631 are visible in FIG. 20. Each of these faces mounts one or more antenna elements, here illustrated as a single column of dipoles 632, 636 and 638.

In all of the embodiments shown herein, one or more antenna elements may be mounted to each face or surface of the antenna structure. The elements may patches, dipoles, radiating slots or other radiating elements without departing from the invention. These elements may be mounted individually, or in columns and rows. For example, in the embodiment of FIG. 17, one of the columns of antenna elements on each surface might be designated as receive elements while the other column is designated as transmit elements. These variations in the numbers, arrangement and types of antenna elements may be as previously as described and illustrated as above, for example, with reference to FIGS. 4, 5 and 7. Also, the additional switching configurations and arrangements including switches, diplexers, transceivers, modems and the like as illustrated in FIGS. 8–12 may be utilized and incorporated in similar fashion in connection with, or on a printed circuit board forming one of the faces of, any of the antenna configurations as illustrated in FIGS. 13–20.

Figure 21:
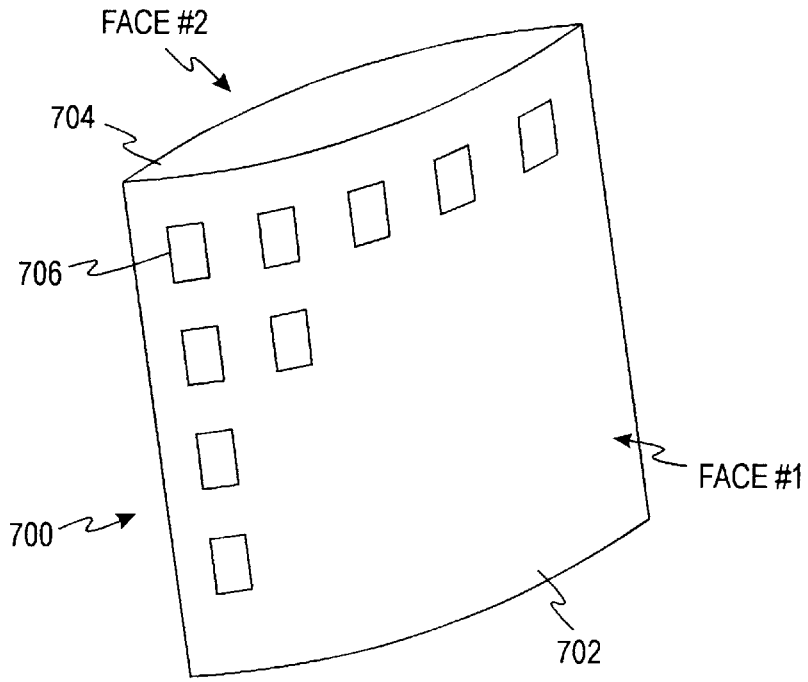
FIG. 21 is a top perspective view of a repeater in accordance with another embodiment of the invention.
Figure 23:
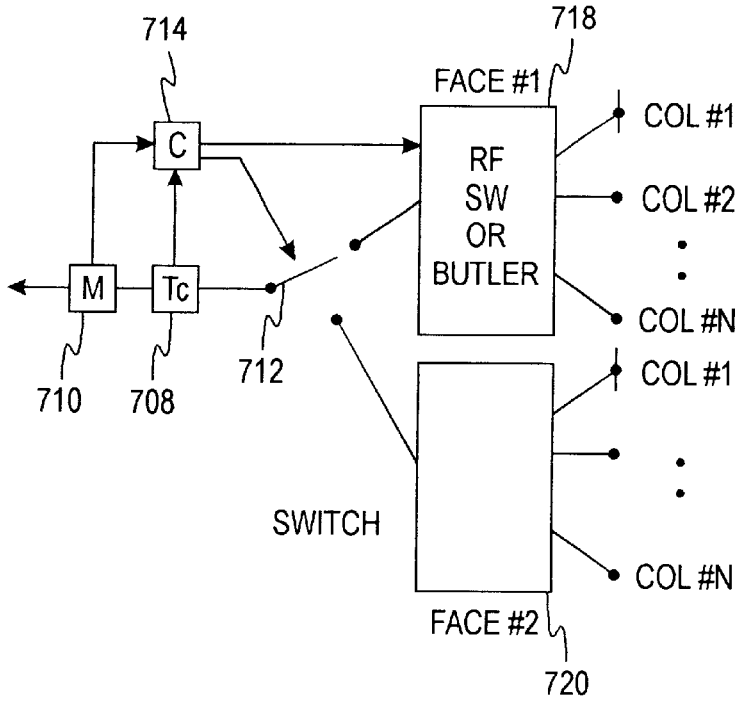
FIG. 23 is a functional block diagram of a beamsteering circuit which might be utilized with the repeater of FIG. 21 (or other repeaters utilizing multiple antenna elements or an antenna array)

In FIG. 21, a antenna structure 700 has respective opposed convex or semielliptical curved surfaces 702 and 704. Each of these surfaces mounts one or more antenna elements 706 which comprise M×N antenna arrays of M rows and N columns as illustrated in FIG. 21. The antenna elements 706 on each of the surfaces 702 and 704 may be summed using a Butler matrix, or other means, such as a bank of radio frequency (RF) switches (one for each column), or a microstrip network or other summing network. FIG. 23 indicates one form of a beamsteering or summing network wherein a transceiver 708 and a modem 710 control operation of a switch 712 via a control circuit 714. The switch 712 may switch between the summing networks or elements for each of the faces 702, 704, such as radio frequency switches or Butler matrixes 718 and 720.

Figure 24:
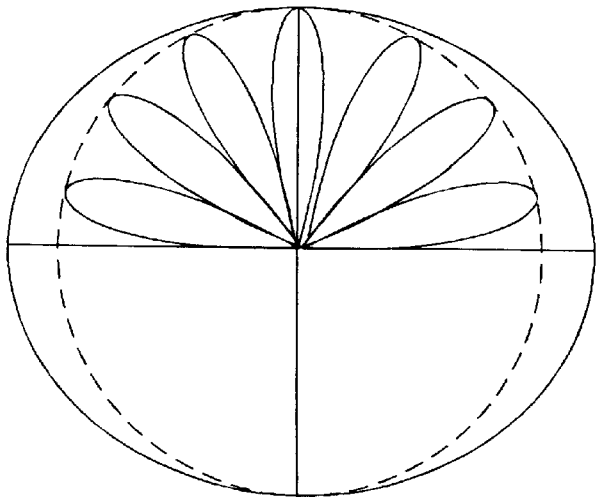
FIG. 24 is an approximation of the radiation pattern or beams which may be generated by the antenna of FIG. 21.

The modem 708, transceiver 710 and control circuit 714 may also select the desired radiating element, or column, via the RF switches, or Butler matrix 718, 720, in accordance with preselected criteria, such as signal strength, or some other measure of signal quality. FIG. 24 indicates generally a number of beam patterns which may be generated by one face of the antenna of FIG. 21 and selected, using one of the above-mentioned ways for summing and/or switching of the antenna elements 706.

Figure 22:
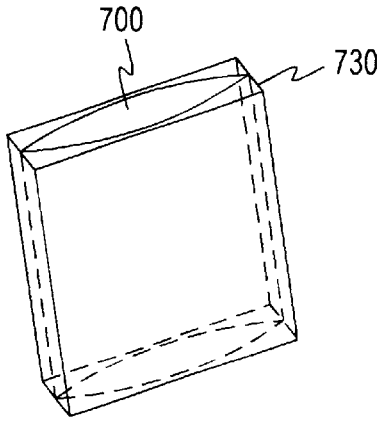
FIG. 22 shows a repeater configured similarly to that of FIG. 21 enclosed within a rectilinear housing.

Referring briefly to FIG. 22, the antenna structure 700 of FIG. 21 may be housed within a rectilinear housing 730, if desired, so as to maintain a rectangular appearance and facilitate mounting to various flat wall or ceiling surfaces, or the like. It will be seen that substantially 360° of coverage may be generated using the curved surfaces or faces 702, 704 and the antenna arrays of the embodiment of FIG. 21.

Figure 25:
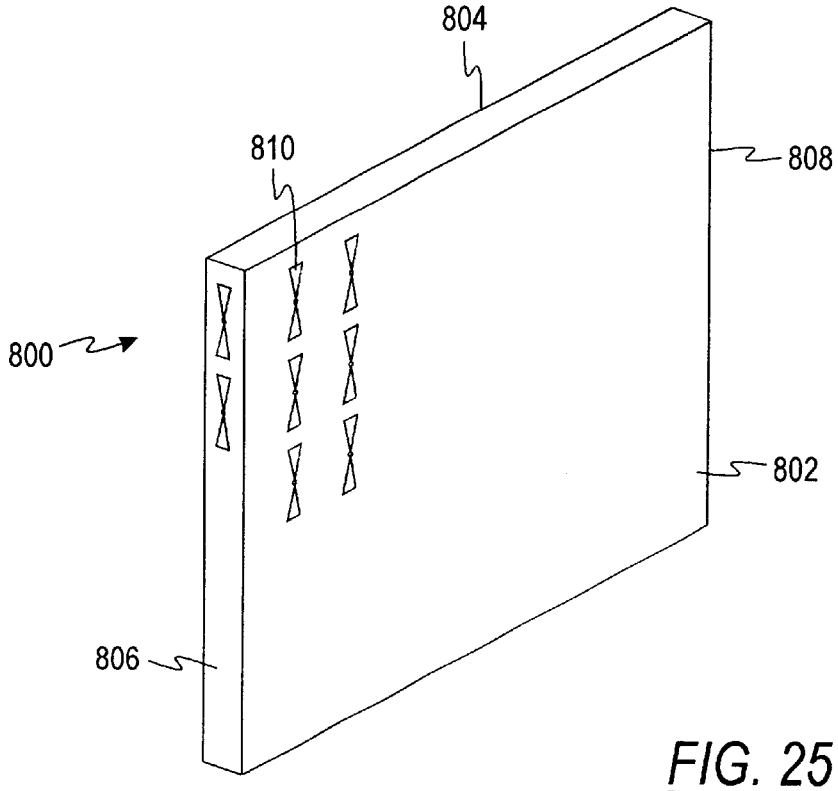
FIG. 25 is a top and side perspective view showing a repeater configured in accordance with yet another embodiment of the invention.
Figure 26:
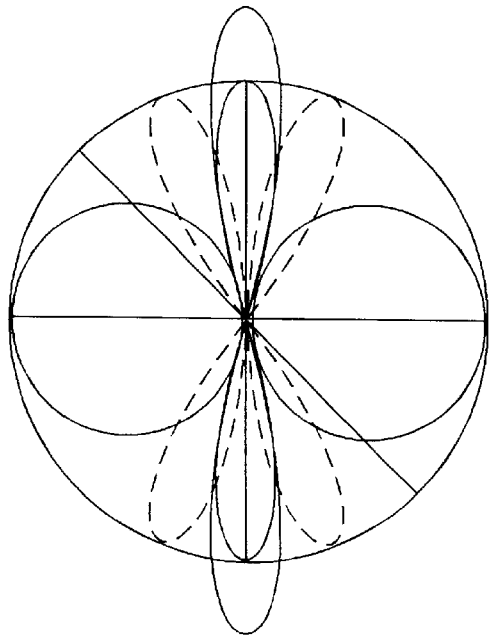
FIG. 26 is an approximation of a beam pattern, illustrating a beamsteering arrangement which might be utilized with the repeater of FIG. 24.

Referring now to FIGS. 25 and 26, yet another antenna configuration or structure 800 for achieving 360° of coverage, including the opposite edge portions of the field, is illustrated. The antenna structure of FIG. 25 is generally rectilinear in form including opposite flat surfaces or faces 802 and 804 and also relatively narrow opposite edge surfaces 806, 808 which are generally orthogonal to the surfaces 802 and 804. Each of the surfaces 802, 804, 806 and 808 mounts one or more radiating elements 810 which are illustrated as dipoles in FIG. 25. It will be understood with respect to FIGS. 21 and 25 that different types of radiating elements may be utilized in much the same fashion as described above with respect to FIGS. 13–20.

In the embodiment of FIG. 25, as illustrated by FIG. 26, the provision of M×N arrays of radiating elements 810 on the surfaces 802 and 804 may be utilized in connection with some form of beamsteering as discussed hereinabove to select an optimum beam direction for a given transmission. However, a single radiating element or single row of radiating elements is mounted on each of the surfaces 806 and 808, which generally have a fixed beam of substantially 90° beam width for covering the edge parts of the field, that is, those portions of the field which are generally perpendicular to the surfaces 802 and 804. Thus, the optimum beam may be selected, as indicated by FIG. 26, in the same fashion as discussed hereinabove in the embodiments of FIGS. 21 and 25.

The antenna(s) of the invention may be used in many applications including without limitation:

MMDS (Wireless Internet)
MMDS (analog video)
Cellular (indoor)
PCS (indoor)
3G systems While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An indoor antenna comprising a support structure having a plurality of relatively planar sections angled with respect to each other, each section having a set of opposing support surfaces, at least one antenna element mounted to each of said opposing support surfaces, and said relatively planar sections and support surfaces being angled and oriented to achieve substantially 360° coverage by said antenna elements.

2. The antenna of claim 1 wherein at least one of said antenna elements comprises a microstrip element.

3. The antenna of claim 1 wherein at least one of said antenna elements comprises a dipole element.

4. The antenna of claim 1 wherein said support structure comprises a pair of substantially planar panels, each panel having opposing planar support surfaces, and said panels being joined along a common edge.

5. The antenna of claim 4 and further including a hinge structure joining said panels along said common edge.

6. The antenna of claim 1 wherein said support structure includes three panels, each of said panels having a pair of opposing planar support surfaces and said panels being joined end-to-end, with first and second outer panels being maintained at substantially right angles to each other by a center panel which extends between and joins said outer panels.

7. The antenna of claim 1 wherein a plurality of antenna elements arranged in at least one vertical column are mounted to each of said support surfaces.

8. The antenna of claim 7 and further including at least one corporate feed structure which operatively interconnects the antenna elements on each support surface.

9. The antenna of claim 8 wherein said corporate feed structure provides amplitude and phase matching to generate a desired elevation beam.

10. The antenna of claim 1 and further including a summation/splitting circuit operatively coupled with said antenna elements, which sums/splits radio frequency signals from said antenna elements to generate a single radio frequency input/output path from/to the antenna system.

11. The antenna of claim 10 wherein said summation/splitting circuit is mounted to said support structure.

12. An indoor antenna comprising a support structure having a plurality of support surfaces, at least one antenna element mounted to each of said support surfaces, and said support surfaces being configured to achieve substantially 360° coverage by said antenna elements, and, further including an RF switch and a modem programmed to sequentially switch an RF path, via said RF switch, to the at least one antenna element mounted to each support surface, and to select the signal from one of said antenna elements based on predetermined criteria.

13. The antenna of claim 12 and further including a transceiver/transverter coupled to receive a signal selected by said RF switch.

14. The antenna of claim 13 wherein said transceiver/transverter is mounted to said support structure.

15. The antenna of claim 12 wherein said RF switch is mounted to said support structure.

16. The antenna of claim 12 wherein said modem is mounted to said support structure.

17. The antenna of claim 12 further including a transceiver/transverter coupled to receive a signal selected by said RF switch wherein said RF switch, modem, and transceiver/transverter are mounted to said support structure.

18. An indoor antenna comprising a support structure having a plurality of sections, each section having a set of opposing support surfaces, at least two antenna elements mounted to each of said support surfaces, one to transmit and one to receive, and said sections and support surfaces being oriented to achieve substantially 360° coverage by said antenna elements.

19. The antenna of claim 18 wherein a group of transmit antenna elements and a group of receive antenna elements, are mounted to each of said support surfaces.

20. The antenna of claim 18 and further including a frequency diplexer for diplexing said transmit and receive antennas into a single transmission line.

21. The antenna of claim 18 and further including a summation circuit coupled with the receive antennas and a splitting circuit coupled with the transmit antennas for generating respective transmit and receive RF input/output ports.

22. The antenna of claim 21 and further including a frequency diplexer for diplexing said RF ports into a single transmission line.

23. An indoor antenna comprising a support structure having a plurality of support surfaces, at least one antenna element mounted to each of said support surfaces, and said support surfaces being configured to achieve substantially 360° coverage by said antenna elements, a plurality of antenna elements arranged in an M row by N column antenna array being mounted to each of said support surfaces, and further including a beamsteering circuit, including a summing circuit for summing signals from each column of each antenna array.

24. The antenna of claim 23 where said beamsteering circuit comprises a Butler matrix.

25. The antenna of claim 23 wherein said beamsteering circuit comprises a radio frequency (RF) switch.

26. the antenna of claim 25 wherein a plurality of RF switches are provided, one for each column of antenna elements in said array.

27. The antenna of claim 23 wherein said summing circuit comprises a microstrip summing network.

28. An indoor antenna comprising a support structure having a plurality of support surfaces, at least one antenna element mounted to each of said support surfaces, and said support surfaces being configured to achieve substantially 360° coverage by said antenna elements, wherein said support surfaces are convexly curved and oppositely facing, and wherein said at least one antenna element comprises an M×N array of antenna elements on each of said support surfaces.

29. An indoor antenna comprising a support structure having a plurality of support surfaces, at least one antenna element mounted to each of said support surfaces, and said support surfaces being configured to achieve substantially 360° coverage by said antenna elements, wherein said support surfaces include a first pair of oppositely facing generally planar support surfaces and a second pair of oppositely facing generally planar edge support surfaces which are generally orthogonal with said first pair of surfaces.

30. The antenna of claim 29 wherein said antenna elements comprise an array of antenna elements on each of said first pair of support surfaces and at least one antenna element on each of said edge support surfaces.

31. A method of transmitting and receiving RF signals comprising:

supporting a plurality of antenna support surfaces on a support structure having a plurality of relatively planar support sections angled with respect to each other, each section having a set of opposing support surfaces;

mounting at least one antenna element to each of said opposing support surfaces; and arranging and angling said relatively planar support sections and support surfaces of the support structure so said antennas are oriented to achieve substantially 360° coverage.

32. The method of claim 31 wherein said supporting comprises coupling a first support having a first set of opposing planar support surfaces along a common edge with a second support section having a second set of opposed planar support surfaces.

33. The method of claim 32 wherein said arranging comprises angling said first and second support sections such that the first set planar support surfaces are substantially orthogonal to said second set planar support surfaces.

34. The method of claim 32 and further including hingedly joining said sections along said common edge.

35. The method of claim 31 wherein said supporting comprises assembling three panels joined end-to-end, each having a pair of opposing planar support surfaces, with first and second outer panels being maintained at substantially right angles to each other by a center panel which joins said outer panels.

36. The method of claim 31 and further including summing/splitting radio frequency signals from said antenna elements to generate a single radio frequency input/output.

37. A method of transmitting and receiving RF signals comprising:

supporting a plurality of antenna support surfaces on a support structure having a plurality of sections, each section having a set of opposing support surfaces;

mounting at least two antenna elements to each of said opposing support surfaces, and designating at least one of said antenna elements to transmit and at least one of said antenna elements to receive; and arranging said support sections and support surfaces of the support structure so said antennas are oriented to achieve substantially 360° coverage.

38. The method of claim 37 including mounting a first group of one or more of said antenna elements on each support surface as transmit antenna elements and mounting a second group of one or more of antenna elements on each support surface as receive antenna elements.

39. The method of claim 38 including arranging each of said first and second groups of antenna elements in a generally vertical column.

40. The method of claim 38 including summing the group of receive antenna elements to one signal output and splitting the group of transmit antenna elements from one signal input.

41. The method of claim 40 and further including diplexing said signal output and signal input onto a single transmission line.

42. The method of claim 37 including arranging a corporate feed structure to provide amplitude and phase matching for said antenna elements so as to generate a desired elevation beam.

43. A method of transmitting and receiving RF signals comprising:

supporting a plurality of antenna support surfaces on a support structure having a plurality of sections, each section having a set of opposing support surfaces;

mounting at least one antenna element to each of said plurality of support surfaces; and arranging said support surfaces of the support structure so said antennas are oriented to achieve substantially 360° coverage; and sequentially switching the RF path to the at least one antenna element mounted to each support surface, and selecting an RF signal from the at least one antenna element mounted on one of said support surfaces based on predetermined criteria.

44. The method of claim 43 including mounting an RF switch to at least one of said support surfaces to perform said sequential switching.

45. The method of claim 44 including using a modem to operate said RF switch.

46. The method of claim 44 and further including coupling a transceiver/transverter to said RF switch.

47. The method of claim 46 and further including mounting said transceiver/transverter to at least one of said support surfaces.

48. A method of transmitting and receiving RF signals comprising:

supporting a plurality of antenna support surfaces on a support structure having a plurality of sections, each section having a set of opposing support surfaces;

mounting at least one antenna element to each of said plurality of support surfaces; and arranging said support surfaces of the support structure so said antennas are oriented to achieve substantially 360° coverage;

said mounting comprising mounting a plurality of antenna elements arranged in an M row by N column antenna array to each of said support surfaces, and further including beamsteering, including summing signals from each column of each antenna array.

49. The method of claim 48 where said beamsteering uses a Butler matrix.

50. The method of claim 48 wherein said beamsteering uses a radio frequency switch.

51. The method of claim 50 wherein said beamsteering uses a plurality of RF switches, one for each column of antenna elements in said array.

52. The method of claim 48 wherein said summing uses a microstrip summing network.

53. A method of transmitting and receiving RF signals comprising:

supporting a plurality of antenna support surfaces on a support structure having a plurality of sections, each section having a set of opposing support surfaces;

mounting at least one antenna element to each of said plurality of support surfaces; and arranging said support surfaces of the support structure so said antennas are oriented to achieve substantially 360° coverage;

said supporting includes supporting a pair of convexly curved support surfaces facing oppositely; and said mounting includes mounting an M×N array of antenna elements on each of said convexly curved support surfaces.

54. A method of transmitting and receiving RF signals comprising:

supporting a plurality of antenna support surfaces on a support structure having a plurality of sections, each section having a set of opposing support surfaces;

mounting at least one antenna element to each of said plurality of support surfaces; and arranging said support surfaces of the support structure so said antennas are oriented to achieve substantially 360° coverage;

said supporting includes supporting a first pair of generally planar support surfaces facing oppositely, and a second pair of generally planar edge support surfaces orthogonal with said first pair of surfaces.

55. The method of claim 54 wherein said mounting comprises mounting an array of antenna elements on each of said first pair of support surfaces and at least one antenna element on each of said edge support surfaces.

* * * * *

UNITED STATES PATENT AND TRADEMARK OFFICE

CERTIFICATE OF CORRECTION

PATENT NO. : 6,448,930 B1
DATED : September 10, 2002
INVENTOR(S) : Mano D. Judd

It is certified that error appears in the above-identified patent and that said Letters Patent is hereby corrected as shown below:

Column 1,
Line 40, reads “demands,, as well as” and should read -- demands, as well as --
Line 57, reads “performnance” and should read -- performance --

Column 2,
Line 28, reads “surfaces being” and should read -- surfaces being configured and oriented to achieve substantially 360° coverage by the antenna elements --

Column 5,
Lines 35 and 48, reads “comer” and should read -- corner --
Line 61, reads “oppositely pair of surfaces” and should read -- oppositely facing pair of surfaces --

Column 7,
Line 20, reads “The elements may patches, dipoles,” and should read -- The elements may be patches, dipoles, --
Line 28, reads “elements may be as previously as described” and should read -- elements may be as previously described --

Column 9,
Line 21, reads “antenna elements, and, further” and should read -- antenna elements, and further --

Signed and Sealed this

Nineteenth Day of August, 2003

JAMES E. ROGAN
*Director of the United States Patent and Trademark Office*